US007431000B2

(12) United States Patent
Fujii et al.

(10) Patent No.: US 7,431,000 B2
(45) Date of Patent: Oct. 7, 2008

(54) VALVE-ACTUATING FOR INTERNAL COMBUSTION ENGINE

(75) Inventors: Noriaki Fujii, Saitama (JP); Hiromu Nakamura, Saitama (JP); Junichi Iwamoto, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 206 days.

(21) Appl. No.: 10/516,947

(22) PCT Filed: Jul. 2, 2003

(86) PCT No.: PCT/JP03/08388

§ 371 (c)(1),
(2), (4) Date: Oct. 7, 2005

(87) PCT Pub. No.: WO2004/011782

PCT Pub. Date: Feb. 5, 2004

(65) Prior Publication Data

US 2006/0102118 A1 May 18, 2006

(30) Foreign Application Priority Data

Jul. 5, 2002 (JP) ..... 2002-196872

(51) Int. Cl.
*F01L 1/18* (2006.01)

(52) U.S. Cl. ..... 123/90.39; 123/90.16; 123/90.44; 74/559; 74/569

(58) Field of Classification Search ..... 123/90.16, 123/90.2, 90.39, 90.44, 90.41; 74/559, 567, 74/569

See application file for complete search history.

(56) References Cited

U.S. PATENT DOCUMENTS

| | | | | |
|---|---|---|---|---|
| 3,598,385 | A | 8/1971 | Parsons, Jr. | |
| 5,000,138 | A | 3/1991 | Bennett | |
| 6,009,842 | A * | 1/2000 | Hiereth | 123/90.27 |

FOREIGN PATENT DOCUMENTS

| | | | |
|---|---|---|---|
| DE | 30 22 188 | A1 | 12/1981 |
| DE | 195 32 334 | A1 | 3/1997 |
| EP | 0 995 885 | A2 | 4/2000 |
| GB | 314 797 | A | 5/1930 |
| GB | 1 137 736 | A | 12/1968 |
| JP | 61-88009 | | 6/1986 |
| JP | 5-71321 | A | 3/1993 |

(Continued)

*Primary Examiner*—Ching Chang
(74) *Attorney, Agent, or Firm*—Arent Fox LLP

(57) ABSTRACT

A pair of link arms each supported at one end thereof on an engine body for swinging movement about an axis parallel to a rotational axis for a valve-operating cam are connected at the other ends, for relative turning movement about an axis parallel to the rotational axis, directly to a rocker arm having a valve abutment abutting against an engine valve and a cam abutment contacting with the valve-operating cam. At least any one of the link arms is swingably supported at one end thereof on the engine body for continuous movement within a plane perpendicular to a rotational axis for the valve-operating cam. Such an arrangement ensures that a valve-operating system can be constructed compactly, and the opening lift amount of the engine valve can be changed continuously, while ensuring an excellent followability to the valve-operating cam.

28 Claims, 8 Drawing Sheets

FOREIGN PATENT DOCUMENTS

| | | | |
|---|---|---|---|
| JP | 5-340227 | A | 12/1993 |
| JP | 6-280523 | | 10/1994 |
| JP | 6-280523 | A | 10/1994 |
| JP | 8-74534 | | 3/1996 |
| JP | 11-246170 | A | 9/1999 |

* cited by examiner

VALVE-ACTUATING FOR INTERNAL COMBUSTION ENGINE

FIELD OF THE INVENTION

The present invention relates to a valve-operating system for an internal combustion engine and particularly, to an improvement in a valve-operating system for an internal combustion engine, which is designed so that the opening lift amount of an engine valve can be changed continuously.

BACKGROUND ART

A valve-operating system for an internal combustion engine designed so that the opening lift amount of an engine valve can be changed continuously is already known, for example, from Japanese Patent Application Laid-open No. 8-74534 or the like. In this valve-operating system, a rocker arm has at one end a valve abutment abutting against an engine valve; one end of a pushrod is fitted over the other end of the rocker arm, and a link mechanism is mounted between the other end of the pushrod and a valve-operating cam.

In the conventional valve-operating system, it is necessary to ensure relatively large spaces for disposition of the link mechanism and the pushrod between the valve-operating cam and the rocker arm, resulting in an increase in size of the valve-operating system. Moreover, a driving force from the valve-operating cam is transmitted through the link mechanism and the pushrod to the rocker arm and hence, it is difficult to mention that the followability of the rocker arm to the valve-operating cam, i.e., the opening/closing followability of the engine valve is excellent.

The present invention has been accomplished with such circumstances in view, and it is an object of the present invention to provide a valve-operating system for an internal combustion engine, wherein the opening lift amount of the engine valve can be changed continuously, while ensuring providing the compactness and ensuring the excellent followability to the valve-operating cam.

DISCLOSURE OF THE INVENTION

To achieve the above object, according to a first aspect and feature of the present invention, there is provided a valve-operating system for an internal combustion engine, comprising a rocker arm having a valve abutment abutting against an engine valve and a cam abutment contacting with a valve-operating cam, and a pair of link arms each of which is supported at one end thereof on an engine body for swinging movement about an axis parallel to a rotational axis for the valve-operating cam and connected at the other end directly to the rocker arm for relative turning movement about an axis parallel to the rotational axis, the one end of at least any one of the link arms being swingably supported on the engine body for continuous movement within a plane perpendicular to the rotational axis for the valve-operating cam.

With such arrangement of the first feature, the opening lift amount of the engine valve can be changed continuously by changing the swinging movement-supporting point of at least any one of the link arms on the engine body continuously. Moreover, the pair of link arms are connected directly to the rocker arm and hence, spaces for disposition of the link arms can be reduced, leading to the compactness of the valve-operating system. A power from the valve-operating cam is transmitted directly to the rocker arm and hence, the excellent followability to the valve-operating cam can be ensured.

According to a second aspect and feature of the present invention, in addition to the arrangement of the first feature, the other ends of the link arms are connected in a row and relatively turnably to the other end of the rocker arm provided at one end thereof with the valve abutment. With such arrangement, the link arms can be disposed more compactly, leading to the further compactness of the valve-operating system.

According to a third aspect and feature of the present invention, in addition to the arrangement of the first or second feature, one of the link arms closer to the valve-operating cam is swingably supported at one end thereof on the engine body in a fixed position, and one of the link arms farther from the valve-operating cam is swingably supported at one end thereof movable on the engine body. With such arrangement, the distance of movement of the link arm with one end movable can be easily ensured, while avoiding the interference with the valve-operating cam.

The above and other objects, features and advantages of the invention will becomes apparent from the detailed description of the preferred embodiments in conjunction with the accompanying drawings.

BRIEF DESCRIPTION OF THE DRAWINGS

FIGS. 1 to 4 show a first embodiment of the present invention, wherein FIG. 1 is a partially vertical sectional view of an internal combustion engine, showing a valve-operating system during a closing operation in a state in which the opening lift amount is large; FIG. 2 is a partially vertical sectional view of the internal combustion engine, showing the valve-operating system during the closing operation in a state in which the opening lift amount is small; FIG. 3 is a sectional view similar to FIG. 2, but during an opening operation in the state in which the opening lift amount is large; and FIG. 4 is a sectional view similar to FIG. 2, but during the opening operation in the state in which the opening lift amount is small;

FIGS. 5 to 8 show a second embodiment of the present invention, wherein FIG. 5 is a partially vertical sectional view of an internal combustion engine, showing a valve-operating system during a closing operation in a state in which the opening lift amount is large; FIG. 6 is a sectional view similar to FIG. 5, but during the closing operation in a state in which the opening lift amount is small; FIG. 7 is a sectional view similar to FIG. 5, but during an opening operation in the state in which the opening lift amount is large; and FIG. 8 is a sectional view similar to FIG. 5, but during the opening operation in the state in which the opening lift amount is small.

BEST MODE FOR CARRYING OUT THE INVENTION

Figure 1:
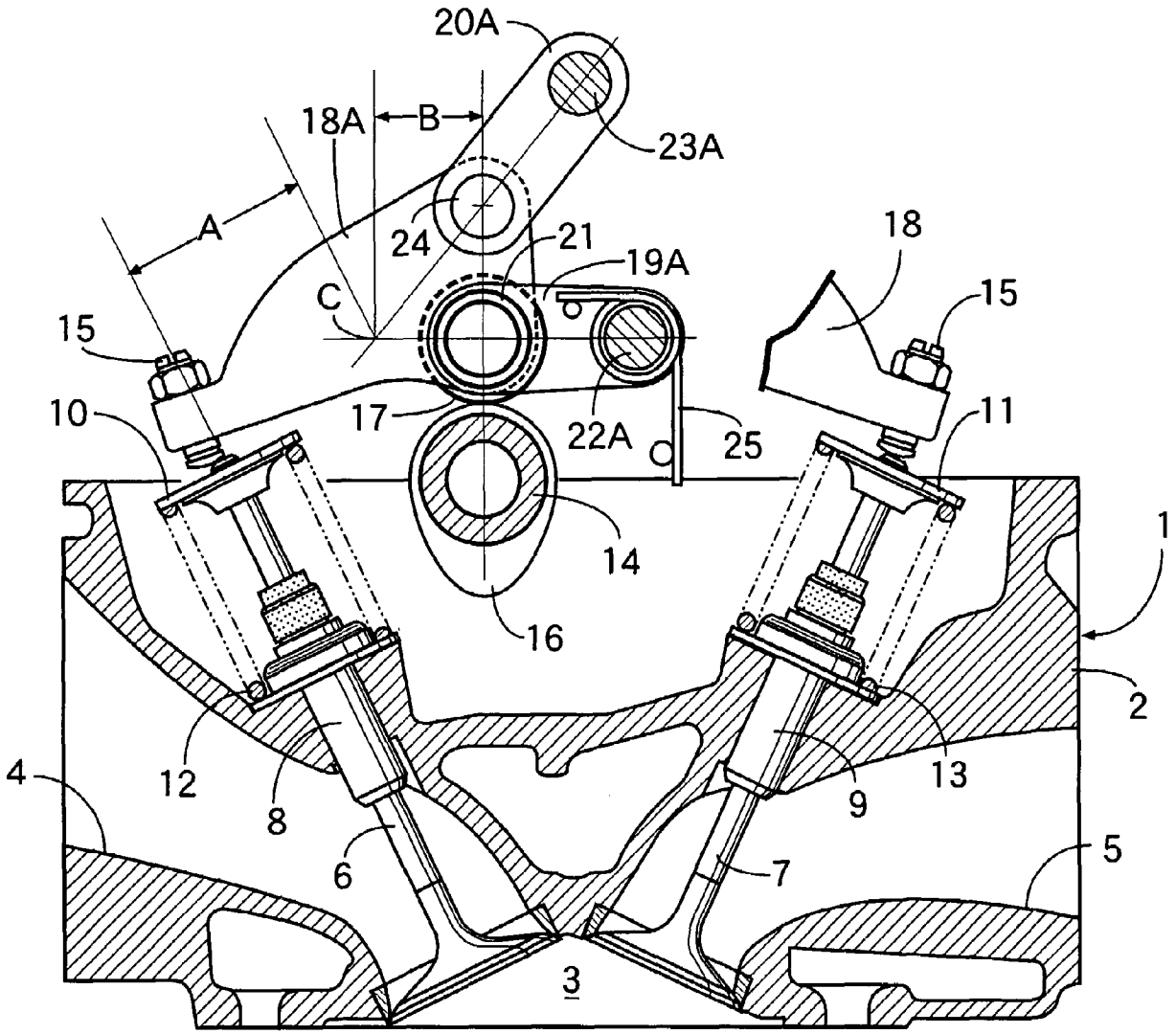

A first embodiment of the present invention will now be described with reference to FIGS. 1 to 4. Referring first to FIG. 1, a cylinder head 2 constituting a portion of an engine body 1 of an internal combustion engine is provided with an intake port 4 and an exhaust port 5 capable of leading to a combustion chamber 3, and includes an intake valve 6 as an engine valve for controlling the amount of an air-fuel mixture flowing from the intake port 4 into the combustion chamber 3, and an exhaust valve 7 for controlling the amount of combustion exhaust gas discharged from the combustion chamber 3 into the exhaust port 5. The intake and exhaust valves 6 and 7 are disposed so that they can be opened and closed.

The cylinder head 2 is provided with a guide tube 8 for guiding the opening and closing operations of the intake valve 6, and a guide tube 9 for guiding the opening and closing operations of the exhaust valve 7. A retainer 10 is fixed to an upper portion of the intake valve 6 protruding from the guide tube 8, and the intake valve 6 is biased in a closing direction by a valve spring 12 mounted between the retainer 10 and the cylinder head 2. A retainer 11 is also fixed to an upper portion of the exhaust valve 7 protruding from the guide tube 9, and the exhaust valve 7 is biased in a closing direction by a valve spring 13 mounted between the retainer 11 and the cylinder head 2.

A valve-operating system for driving the intake valve 6 to open and close it includes a camshaft 14 disposed above the intake valve 6 and rotatably supported on the cylinder head 2 and a holder (not shown) coupled to the cylinder head 2, and a rocker arm 18A which is disposed above the camshaft 14 and has a tappet screw 15 as a valve abutment abutting against an upper end of the intake valve 6 and a roller 17 as a cam abutment contacting with a valve-operating cam 16 provided on the camshaft 14, and first and second link arms 19A and 20A connected to the rocker arm 18A.

The tappet screw 15 is threadedly engaged with one end of the rocker arm 18A, so that its advanced and retracted positions can be adjusted. The roller 17 which is in rolling contact with the valve-operating cam 16 is rotatably supported on a cylindrical support tube 21 mounted at the other end of the rocker arm 18A and having a rotational axis for the valve-operating cam 16, i.e., an axis parallel to an axis of the camshaft 14.

Each of support shafts 22A and 23A having an axis parallel to the camshaft 14 is mounted at one end of each of the first and second link arms 19A and 20A. The support shafts 22A and 23A are rotatably connected to the cylinder head 2 in the engine body 1. Namely, each of the first and second link arms 19A and 20A is supported at one end on the cylinder head 2 for swinging movement about an axis parallel to the rotational axis for the valve-operating cam 16.

The first link arm 19A is connected at the other end thereof directly to the other end of the rocker arm 18A for relative turning movement about an axis parallel to the rotational axis for the valve-operating cam 16, and the second link arm 20A disposed above the first link arm 19A is connected at the other end thereof directly to the other end of the rocker arm 18A for relative turning movement about an axis parallel to the rotational axis for the valve-operating cam 16 in such a manner that it is arranged above and in a row with the other end of the first link arm 19A. Namely, the other end of the first link arm 19A is connected to the support tube 21, and the other end of the second link arm 20A is connected to the other end of the rocker arm 18A above the roller 17 through a connecting shaft 24 parallel to the roller 17. The support tube 21 and the connecting shaft 24 are disposed to extend in an input direction from the valve-operating cam 16 to the rocker arm 18A.

It should be noted here that the support shaft 22A mounted at one end of one 19A of the first and second link arms 19A and 20A closer to the valve-operating cam 16 is swingably supported on the cylinder head 2 in a fixed position, whereas the support shaft 23A mounted at one end of one 20A of the first and second link arms 19A and 20A farther from the valve-operating cam 16 is swingably supported on the cylinder head 2 for continuous movement within a plane perpendicular to the rotational axis for the valve-operating cam 16, i.e., the axis of the camshaft 14, and is driven by an electric motor, an electromagnetic actuator, a hydraulic mechanism and the like.

Moreover, one end of each of the first and second link arms 19A and 20A is disposed on a side opposite from the intake valve 6 with respect to the other end of each of the first and second link arms 19A and 20A. Such disposition makes it possible to avoid that a turning movement-supporting structure at one end of each of the first and second link arms 19A and 20A and a driving structure at one end of the second link arm 20A interfere with members such as the retainer 10 and the valve spring 12 associated with the intake valve 6.

To ensure that the roller 17 is always in sliding contact with the valve-operating cam 16, for example, a torsion spring 25 is mounted between the first link arm 19A and the cylinder head 2 to surround the support shaft 22A mounted at one end of the first link arm 19A.

Figure 2:
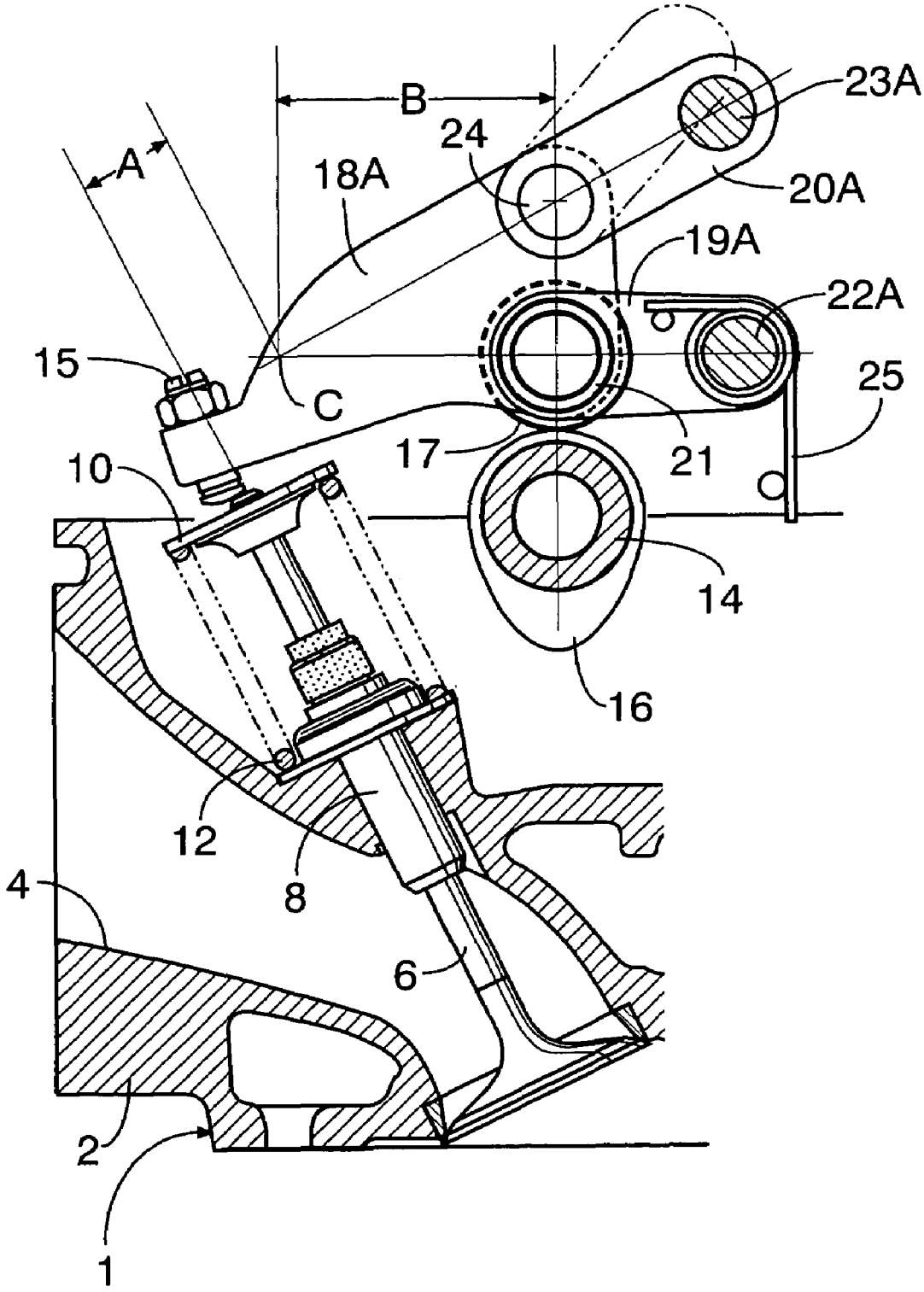

In the valve-operating system of such arrangement, if the lift amount of the intake valve 6 is desired to assume the maximum value, the support shaft 23A of the second link arm 20A is disposed at a position shown in FIG. 1, and if the lift amount of the intake valve 6 is desired to be decreased, for example, to about 20% of the maximum lift amount, the support shaft 23A of the second link arm 20A is moved downwards from the position shown in FIG. 1 (the position shown by a dashed line) as shown in FIG. 2.

An instantaneous center C of the rocker arm 18A is a point of intersection of a straight line connecting the axes of the support shaft 22A and the support tube 21 to each other and a straight line connecting the axes of the support shaft 23A and the connecting shaft 24. An instantaneous center C of the rocker arm 18A when the support shaft 23A has been displaced to the position shown in FIG. 2 has been displaced to a position in proximity to the intake valve 6 with respect to an instantaneous center C of the rocker arm 18A when the support shaft 23A is in the position shown in FIG. 1. Thus, a lever ratio (=A/B) which is a ratio of a distance A between a contact point of the tappet screw 15 with the intake valve 6 and the instantaneous center C to a distance B between a contact point of the roller 17 with the valve-operating cam 16 and the instantaneous center C is varied, and the lever ratio in a state shown in FIG. 2 is smaller than that in a state shown in FIG. 1.

Figure 3:
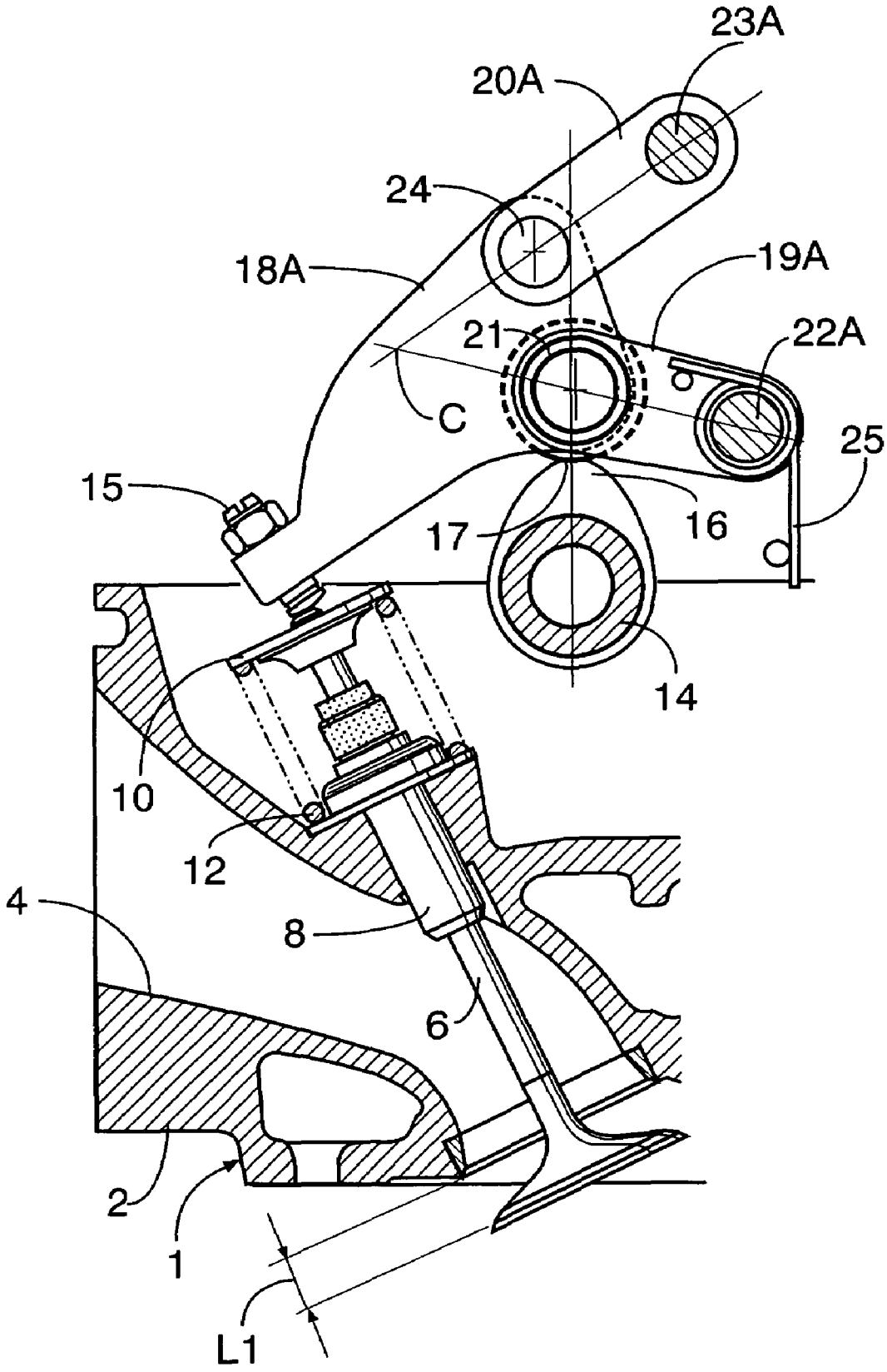
Figure 4:
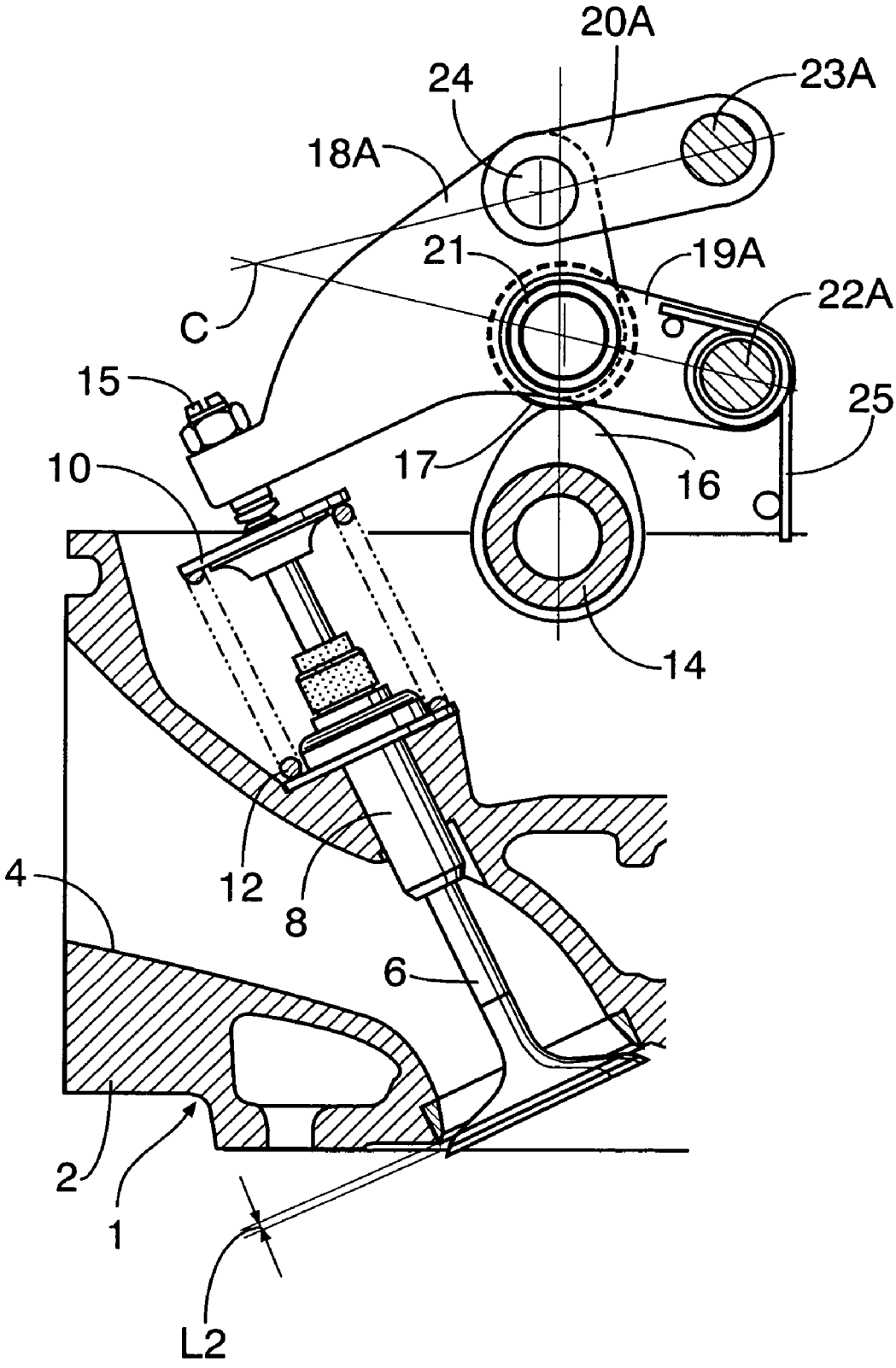

With such a variation in lever ratio, when the roller 17, i.e., the other end of the rocker arm 18A is pushed up by the valve-operating cam 16 when the support shaft 23A is in the position shown in FIG. 1, an opening lift amount L1 of the intake valve 6 assumes a maximum value, as shown in FIG. 3, and when the roller 17, i.e., the other end of the rocker arm 18A is pushed up by the valve-operating cam 16 when the support shaft 23A is in the position shown in FIG. 2, an opening lift amount L2 of the intake valve 6 assumes a value as low as, for example, 20% of the maximum lift amount L1, as shown in FIG. 4.

Moreover, the position of the support shaft 23A can be changed continuously, and the lever ratio can be changed continuously by the continuous change in position of the support shaft 23A, whereby the opening lift amount of the intake valve 6 can be changed continuously.

A valve-operating system for driving the exhaust valve 7 to open and close the latter is constructed as is the above-described valve-operating system for driving the intake valve 6 to open and close the latter, and includes a rocker arm 18 having at one end the tappet screw 15 as a valve abutment which abuts against an upper end of the exhaust valve 7.

The operation of the first embodiment will be described below. The first and second link arms 19A and 20A supported at one ends thereof on the cylinder head 2 for swinging movement about the axis parallel to the rotational axis for the valve-operating cam 16 are connected at the other ends directly to the rocker arm 18A for relatively turning movement about the axis parallel to the rotational axis. The second link arm 20A is swingably supported at the one end thereof on the cylinder head 2 for continuous movement within the plane perpendicular to the rotational axis for the valve-operating cam 16.

Therefore, the instantaneous center C of the rocker arm 18A is changed by continuously changing the swinging movement-supporting point of the second link arm 20A on the cylinder head 2. Thus, the lever ratio can be changed continuously, whereby the opening lift amount of the intake valve 6 can be changed continuously.

Moreover, the first and second link arms 19A and 20A are connected directly to the rocker arm 18A and hence, spaces for disposition of the link arms 19A and 20A can be reduced to provide the compactness to the valve-operating system. A power from the valve-operating system 16 is transmitted directly to the rocker arm 18A and hence, an excellent followability to the valve-operating cam 16 can be ensured.

The other ends of the first and second link arms 19A and 20A are connected in a row and relatively turnably to the other end of the rocker arm 18A provided at one end with the tappet screw 15. Therefore, the link arms 19A and 20A can be disposed more compactly, leading to the further compactness of the valve-operating system.

Further, one 19A of the first and second link arms 19A and 20A closer to the valve-operating cam 16 is swingably supported at one end on the cylinder head 2 in the fixed position, and the other 20A of the first and second link arms 19A and 20A farther from the valve-operating cam 16 is swingably supported at one end movable on the cylinder head 2. Therefore, the distance of movement of the second link arm 20A with one end movable can be easily ensured, while avoiding the interference with the valve-operating cam 16.

Moreover, the first link arm 19A is connected to the rocker arm 18A through the support tube 21 mounted on the rocker arm 18A to support the roller 17 which is in rolling contact with the valve-operating cam 16, and the support tube 21 also serves as a connecting shaft. Therefore, it is unnecessary to separately mount an exclusive connecting shaft for connecting the first link arm 19A, thereby enabling a reduction in number of parts and contributing to a reduction in size of the rocker arm 18A.

Further, the support tube 21 and the connecting shaft 24 are disposed to extend in the input direction from the valve-operating cam 16 to the rocker arm 18A and hence, the efficiency of transmission from the valve-operating cam 16 to the rocker arm 18A can be enhanced, while avoiding that the connecting shaft 24 interferes with the valve-operating cam 16.

Figure 5:
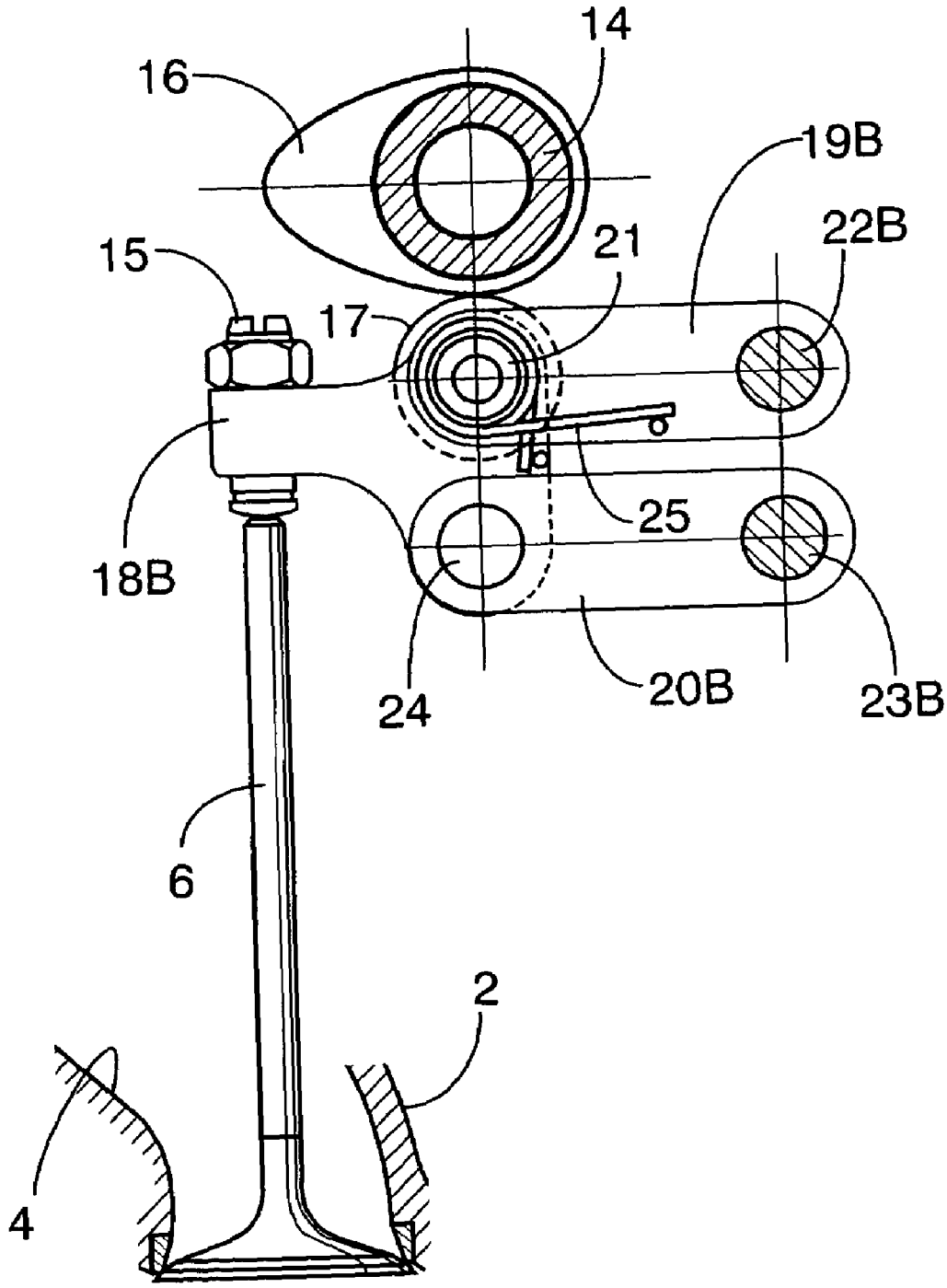

A second embodiment of a second embodiment of the present invention will now be described with reference to FIGS. 5 to 8. Referring to first to FIG. 5, a valve-operating system for driving an intake valve 6 to open and close it includes a camshaft 14 disposed above the intake valve 6 and rotatably supported on a cylinder head 2 and a holder (not shown) coupled to a cylinder head 2, a rocker arm 18B which is disposed below the camshaft 14 and which has a tappet screw 15 as a valve abutment abutting against an upper end of the intake valve 6 and a roller 17 as a cam abutment contacting with a valve-operating cam 16 provided on the camshaft 14, and first and second link arms 19B and 20B connected to the rocker arm 18B.

The roller 17 which is in rolling contact with the valve-operating cam 16 is rotatably supported on a cylindrical support tube 21 mounted at an upper portion of the other end of the rocker arm 18B and having an axis parallel to an axis of the camshaft 14.

Support shafts 22B and 23B having axes parallel to the camshaft 14 are mounted at one ends of the first and second link arms 19B and 20B, respectively and turnably connected to the cylinder head 2. Namely, each of the first and second link arms 19B and 20B is supported at one end on the cylinder head 2 for swinging movement about an axis parallel to a rotational axis for the valve-operating cam 16.

The other end of the first link arm 19B is connected to the support tube 21. Namely, the other end of the first link arm 19B is connected directly to the other end of the rocker arm 18B for relative turning movement about an axis parallel to the rotational axis for the valve-operating cam 16. In addition, the second link arm 20B is disposed below the first link arm 19B and connected at the other end to the other end of the rocker arm 18B below the roller 17 through a connecting shaft 24 parallel to the roller 17. Namely, the second link arm 20B is connected at the other end directly to the other end of the rocker arm 18B for relative turning movement about the axis parallel to the rotational axis for the valve-operating cam 16 in such a manner that it is arranged below in a row with the other end of the first link arm 19B.

Moreover, the support shaft 22B mounted at one end of one 19B of the first and second link arms 19B and 20B closer to the valve-operating cam 16 is swingably supported on the cylinder head 2 in a fixed position, and the support shaft 23B mounted at one end of the other 20B of the first and second link arms 19B and 20B farther from the valve-operating cam 16 is swingably supported on the cylinder head 2 for continuous movement within a plane perpendicular to the rotational axis for the valve-operating cam 16, i.e., the axis of the camshaft 14.

To ensure that the roller 17 is always in sliding contact with the valve-operating cam 16, for example, a torsion spring 25 is mounted between the first link arm 19B and the rocker arm 18B to surround the support tube 21 mounted at the other end of the first link arm 19B.

Figure 6:
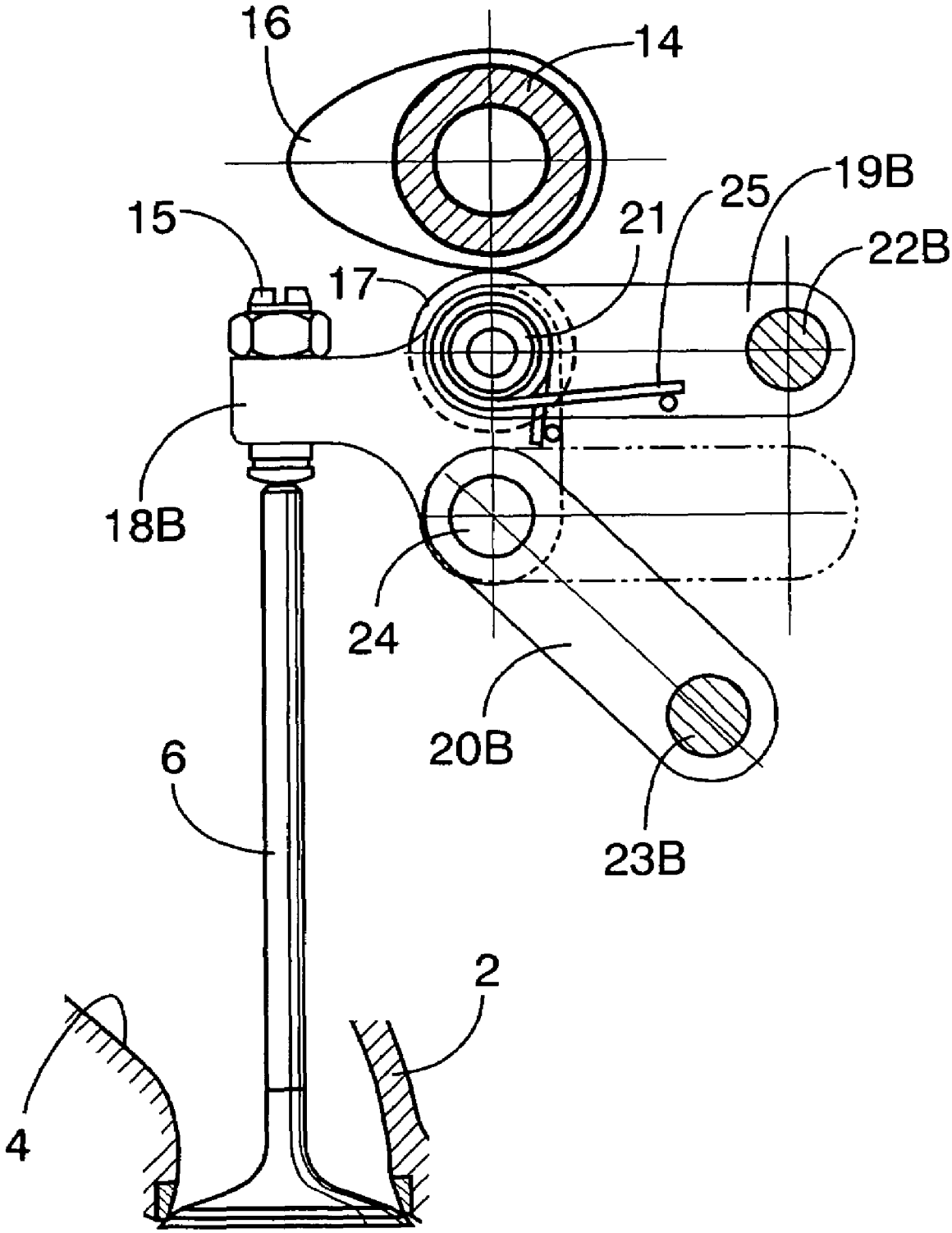

In such valve-operating system, if the lift amount of the intake valve 6 is desired to assume the maximum value, the support shaft 23B of the second link arm 20B is disposed at a position shown in FIG. 5, and if the lift amount of the intake valve 6 is desired to be decreased, for example, to "0", the support shaft 23B of the second link arm 20B is moved downwards from the position shown in FIG. 5 (the position shown by a dashed line) as shown in FIG. 5), as shown in FIG. 6.

Figure 7:
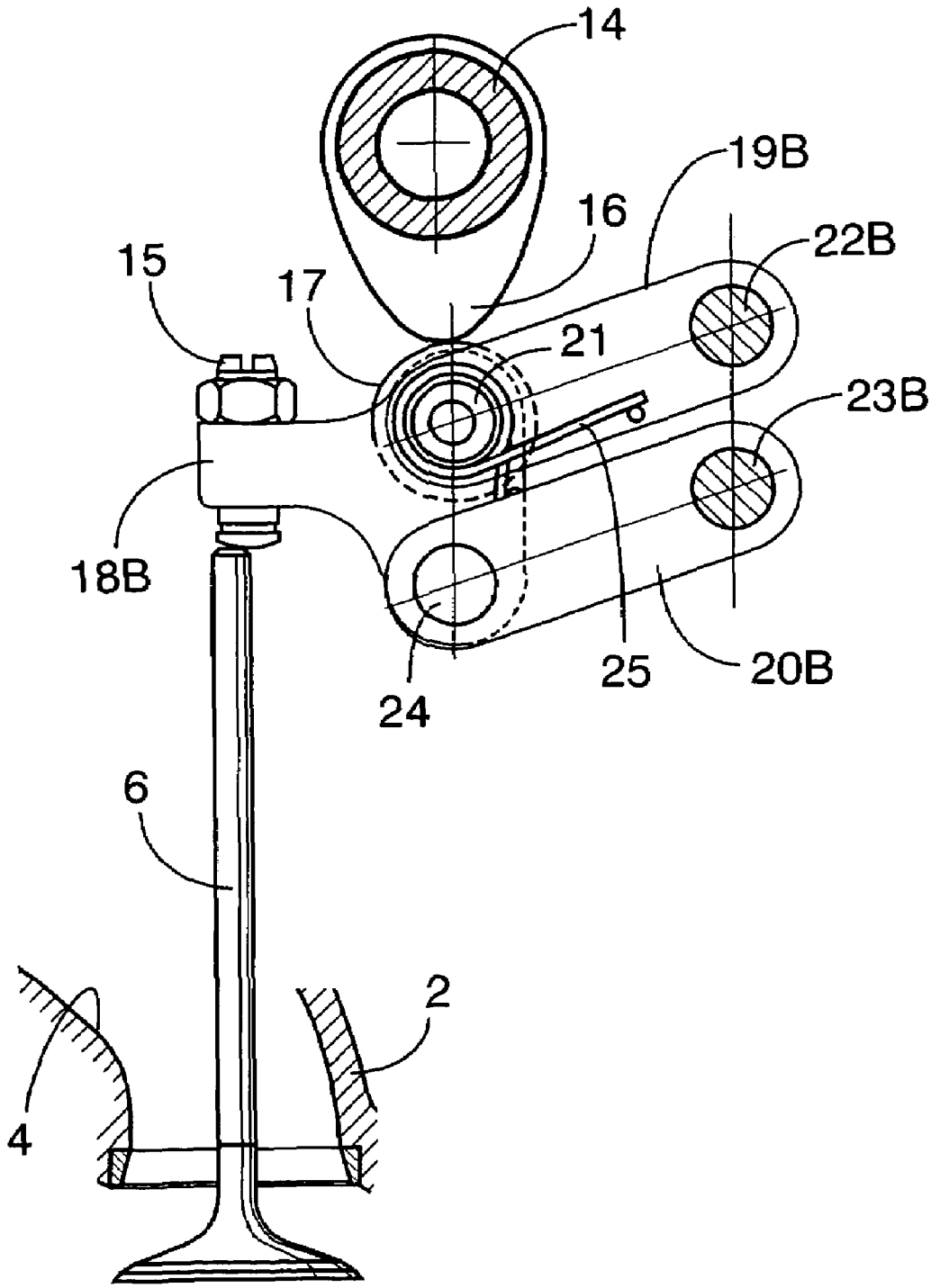
Figure 8:
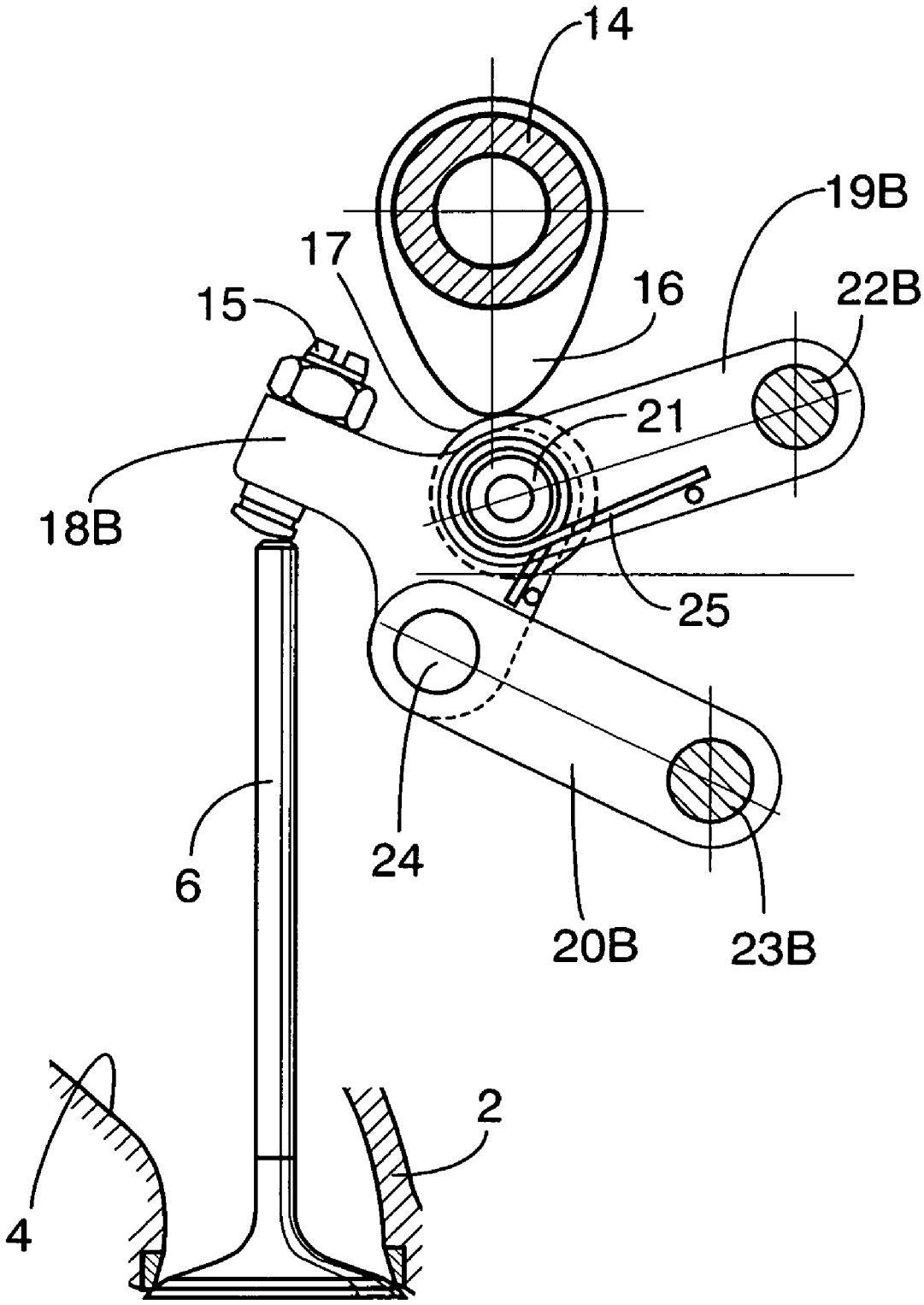

When the roller 17, i.e., the other end of the rocker arm 18B is pushed down by the valve-operating cam 16 when the support shaft 23B is in the position shown in FIG. 5, the opening lift amount of the intake valve 6 assumes the maximum value, as shown in FIG. 7. On the other hand, when the roller 17, i.e., the other end of the rocker arm 18B is pushed down by the valve-operating cam 16 when the support shaft 23B is in the position shown in FIG. 6, the intake valve 6 remains closed and stopped, as shown in FIG. 8.

Moreover, the position of the support shaft 23B can be changed continuously, and the opening lift amount of the intake valve 6 can be changed continuously by continuously changing the position of the support shaft 23B.

Even according to the second embodiment, the opening lift amount of the intake valve 6 can be changed continuously by continuously changing the swinging movement-supporting point of the second link arm 20B on the cylinder head 2.

Moreover, the first and second link arms 19B and 20B are connected directly to the rocker arm 18B and hence, spaces for disposition of the link arms 19B and 20B can be reduced, leading the compactness of the valve-operating system. A power from the valve-operating system 16 is transmitted directly to the rocker arm 18B and hence, an excellent followability to the valve-operating cam 16 can be ensured.

The other ends of the first and second link arms 19B and 20B are connected in a row and relatively turnably to the other end of the rocker arm 18B provided at one end with the tappet screw 15. Therefore, the link arms 19A and 20A can be disposed more compactly, leading to the further compactness of the valve-operating system.

Further, one 19B of the first and second link arms 19B and 20B closer to the valve-operating cam 16 is swingably supported at one end on the cylinder head 2 in the fixed position, and one 20B of the first and second link arms 19B and 20B farther from the valve-operating cam 16 is swingably supported at one end movable on the cylinder head 2. Therefore, the distance of movement of the second link arm 20B with one end movable can be easily ensured, while avoiding the interference with the valve-operating cam 16.

Although the embodiments of the present invention have been described in detail, it will be understood that the present invention is not limited to the above-described embodiments, and various modifications in design may be made without departing from the spirit and scope of the invention defined in claims.

For example, the one end of one of the pair of link arms 19A and 20A; 19B and 20B is movable in each of the above-described embodiments, but both of the one ends of both the link arms 19A and 20A; 19B and 20B may be movable.

The present invention is applicable not only to the valve-operating system for the internal combustion engine for the vehicle but also to a valve-operating system for an internal combustion engine for a boat propelling machine such as an outboard engine system including a crankshaft supported to be directed vertically.

What is claimed is:

1. A valve-operating system for an internal combustion engine, comprising a rocker arm having a valve abutment at one end thereof abutting against an engine valve and a cam abutment at the other end contacting with a valve-operating cam, and a pair of link arms each of which is supported at one end thereof on an engine body for swinging movement about an axis parallel to a rotational axis for said valve-operating cam and connected at the other end directly to the other end of said rocker arm for relative turning movement about an axis parallel to said rotational axis, said one end of at least any one of said link arms being swingably supported on said engine body for continuous movement within a plane perpendicular to the rotational axis for said valve-operating cam, and wherein said rocker arm is formed to be gradually thicker from the valve abutment at the one end toward the cam abutment at the other end, and wherein the other ends of the pair of link arms connected to the other end of the rocker arm are positioned on a line in an input direction from the valve-operating cam to the rocker arm.

2. A valve-operating system for an internal combustion engine according to claim 1, wherein said link arms are connected at the other ends in a row and relatively turnably to the other end of said rocker arm.

3. A valve-operating system for an internal combustion engine according to claim 1 or 2, wherein one of said link arms closer to said valve-operating cam is swingably supported at one end thereof on the engine body.

4. A valve-operating system for an internal combustion engine according to claim 3, wherein one ends of said link arms are disposed on a side opposite from said engine valve with respect to the other ends of said link arms.

5. A valve-operating system for an internal combustion engine according to claim 1 or 2, wherein one ends of said link arms are disposed on a side opposite from said engine valve with respect to the other ends of said link arms. in a fixed position, and one of said link arms farther from said valve-operating cam is swingably supported at one end thereof movable on the engine body.

6. A valve-operating system for an internal combustion engine, comprising a rocker arm having a valve abutment at one end thereof abutting against an engine valve and a cam abutment at the other end contacting with a valve-operating cam, and a pair of link arms each of which is supported at one end thereof on an engine body for swinging movement about an axis parallel to a rotational axis for said valve-operating cam and connected at the other end directly to the other end of said rocker arm for relative turning movement about an axis parallel to said rotational axis, said one end of at least any one of said link arms being swingably supported on said engine body for continuous movement within a plane perpendicular to the rotational axis for said valve-operating cam, and wherein the roller as said cam abutment is turnably supported on a cylindrical support tube mounted on said rocker arm and having an axis parallel to said rotational axis for said valve-operating cam, and one of said link arms is connected at the other end to said support tube.

7. A valve-operating system for an internal combustion engine according to claim 6, wherein the other of said link arms is connected at the other end to said rocker arm above the roller through a connecting shaft parallel to the roller, and the support tube and the connecting shaft are disposed to extend in an input direction from the valve-operating cam to said rocker arm.

8. A valve-operating system for an internal combustion engine according to claim 6, wherein the other of said link arms is connected at the other end to said rocker arm below said roller through a connecting shaft parallel to said roller, and the support tube and the connecting shaft are disposed to extend in an input direction from the valve-operating cam to said rocker arm.

9. A valve-operating system for an internal combustion engine according to claim 7, wherein one ends of said link arms are disposed on a side opposite from said engine valve with respect to the other ends of said link arms.

10. A valve-operating system for an internal combustion engine according to claim 8, wherein one ends of said link arms are disposed on a side opposite from said engine valve with respect to the other ends of said link arms.

11. A valve-operating system for an internal combustion engine according to claim 6, wherein one ends of said link arms are disposed on a side opposite from said engine valve with respect to the other ends of said link arms.

12. A valve-operating system for an internal combustion engine, comprising a rocker arm having a valve abutment at one end thereof abutting against an engine valve and a cam abutment at the other end contacting with a valve-operating cam, and a pair of link arms each of which is supported at one end thereof on an engine body for swinging movement about an axis parallel to a rotational axis for said valve-operating cam and connected at the other end directly to the other end of said rocker arm for relative turning movement about an axis parallel to said rotational axis, said one end of at least any one of said link arms being swingably supported on said engine body for continuous movement within a plane perpendicular to the rotational axis for said valve-operating cam, wherein one of said link arms closer to said valve-operating cam is swingably supported at one end thereof on the engine body in a fixed position, and one of said link arms farther from said valve-operating cam is swingably supported at one end thereof movable on the engine body, and wherein the roller as said cam abutment is turnably supported on a cylindrical support tube mounted on said rocker arm and having an axis parallel to a rotational axis for said valve-operating cam, and one of said link arms closer to said valve-operating cam is connected at the other end to said support tube.

13. A valve-operating system for an internal combustion engine according to claim 12, wherein one of said link arms farther from said valve-operating cam is connected at the other end to said rocker arm above the roller through a connecting shaft parallel to the roller, and the support tube and the connecting shaft are disposed to extend in an input direction from the valve-operating cam to said rocker arm.

14. A valve-operating system for an internal combustion engine according to claim 13, wherein one ends of said link arms are disposed on a side opposite from said engine valve with respect to the other ends of said link arms.

15. A valve-operating system for an internal combustion engine according to claim 12, wherein one of said link arms farther from said valve-operating cam is connected at the other end to said rocker arm below said roller through a connecting shaft parallel to said roller, and the support tube and the connecting shaft are disposed to extend in an input direction from the valve-operating cam to said rocker arm.

16. A valve-operating system for an internal combustion engine according to claim 15, wherein one ends of said link arms are disposed on a side opposite from said engine valve with respect to the other ends of said link arms.

17. A valve-operating system for an internal combustion engine according to claim 12, wherein one ends of said link arms are disposed on a side opposite from said engine valve with respect to the other ends of said link arms.

18. A valve-operating system for an internal combustion, comprising a rocker arm having a valve abutment at one end thereof abutting against an engine valve and a cam abutment at the other end contacting with a valve-operating cam, and a pair of link arms each of which is supported at one end thereof on an engine body for swinging movement about an axis parallel to a rotational axis for said valve-operating cam and connected at the other end directly to the other end of said rocker arm for relative turning movement about an axis parallel to said rotational axis, said one end of at least any one of said link arms being swingably supported on said engine body for continuous movement within a plane perpendicular to the rotational axis for said valve-operating cam, wherein said link arms are connected at the other ends in a row and relatively turnably to the other end of said rocker arm, and wherein the roller as said cam abutment is turnably supported on a cylindrical support tube mounted on said rocker arm and having an axis parallel to said rotational axis for said valve-operating cam, and one of said link arms is connected at the other end to said support tube.

19. A valve-operating system for an internal combustion engine according to claim 18, wherein the other of said link arms is connected at the other end to said rocker arm above the roller through a connecting shaft parallel to the roller, and the support tube and the connecting shaft are disposed to extend in an input direction from the valve-operating cam to said rocker arm.

20. A valve-operating system for an internal combustion engine according to claim 19, wherein one ends of said link arms are disposed on a side opposite from said engine valve with respect to the ends of said link arms.

21. A valve-operating system for an internal combustion engine according to claim 18, wherein the other of said link arms is connected at the other end to said rocker arm below said roller through a connecting shaft parallel to said roller, and the support tube and the connecting shaft are disposed to extend in an input direction from the valve-operating cam to said rocker arm.

22. A valve-operating system for an internal combustion engine according to claim 21, wherein one ends of said link arms are disposed on a side opposite from said engine valve with respect to the other ends of said link arms.

23. A valve-operating system for an internal combustion engine according to claim 18, wherein one ends of said link arms are disposed on a side opposite from said engine valve with respect to the other ends of said link arms.

24. A valve-operating system for an internal combustion engine, comprising a rocker arm having a valve abutment at one end thereof abutting against an engine valve and a cam abutment at the other end contacting with a valve-operating cam, and a pair of link arms each of which is supported at one end thereof on an engine body for swinging movement about an axis parallel to a rotational axis for said valve-operating cam and connected at the other end directly to the other end of said rocker arm for relative turning movement about an axis parallel to said rotational axis, said one end of at least any one of said link arms being swingably supported on said engine body for continuous movement within a plane perpendicular to the rotational axis for said valve-operating cam, wherein said link arms are connected at the other ends in a row and relatively turnably to the other end of said rocker arm, wherein one of said link arms closer to said valve-operating cam is swingably supported at one end thereof on the engine body in a fixed position, and one of said link arms farther from said valve-operating cam is swingably supported at one end thereof movable on the engine body, and wherein the roller as said cam abutment is turnably supported on a cylindrical support tube mounted on said rocker arm and having an axis parallel to a rotational axis for said valve-operating cam, and one of said link arms closer to said valve-operating cam is connected at the other end to said support tube.

25. A valve-operating system for an internal combustion engine according to claim 24, wherein one of said link arms farther from said valve-operating cam is connected at the other end to said rocker arm above the roller through a connecting shaft parallel to the roller, and the support tube and the connecting shaft are disposed to extend in an input direction from the valve-operating cam to said rocker arm.

26. A valve-operating system for an internal combustion engine according to claim 25, wherein one ends of said link arms are disposed on a side opposite from said engine valve with respect to the other ends of said link arms.

27. A valve-operating system for an internal combustion engine according to claim 24, wherein one of said link arms farther from said valve-operating cam is connected at the other end to said rocker arm below said roller through a connecting shaft parallel to said roller, and the support tube and the connecting shaft are disposed to extend in an input direction from the valve-operating cam to said rocker arm.

28. A valve-operating system for an internal combustion engine according to claim 27, wherein one ends of said link arms are disposed on a side opposite from said engine valve with respect to the other ends of said link arms.

* * * * *